United States Patent [19]

Martin

[11] Patent Number: 4,524,305

[45] Date of Patent: Jun. 18, 1985

[54] SOLID STATE REGULATED POWER SUPPLY SYSTEM FOR COLD CATHODE LUMINESCENT TUBE

[75] Inventor: Marshal H. Martin, Northridge, Calif.

[73] Assignee: Indicator Controls Corp., Gardena, Calif.

[21] Appl. No.: 521,457

[22] Filed: Aug. 8, 1983

[51] Int. Cl.[3] ..... H05B 37/02

[52] U.S. Cl. ..... 315/221; 315/222; 315/244; 315/DIG. 7

[58] Field of Search ..... 315/221, 222, 244, DIG. 2, 315/DIG. 7, 307, 308

[56] References Cited

U.S. PATENT DOCUMENTS

| | | | |
|---|---|---|---|
| 3,072,822 | 1/1963 | Holmes | 315/307 |
| 3,449,629 | 6/1969 | Wigert et al. | 315/308 |
| 3,611,021 | 10/1971 | Wallace | 315/307 |
| 3,967,159 | 6/1976 | Dendy et al. | 315/308 |
| 4,395,659 | 7/1983 | Aoike et al. | 315/307 |
| 4,415,839 | 11/1983 | Lesea | 315/308 |

*Primary Examiner*—Harold Dixon

*Attorney, Agent, or Firm*—Keith D. Beecher

[57] ABSTRACT

A solid state power supply and light emission controller for a cold cathode luminescent tube which converts alternating current line voltage, or direct current voltage, into a variable repetition rate pulse alternating current voltage for energizing the tube and for controlling the light emission of the tube. The power supply provides for essentially constant light emission from the tube in the presence of variations in the internal impedance of the tube, variations in ambient temperature, and variations in line voltage. The power supply finds use, for example, with cold cathode luminescent tubes such as neon tubes, and the like.

6 Claims, 2 Drawing Figures

SOLID STATE REGULATED POWER SUPPLY SYSTEM FOR COLD CATHODE LUMINESCENT TUBE

BACKGROUND OF THE INVENTION

The invention is directed to a simplified version of the solid state power supply described in copending application Ser. No. 497,185 filed May 23, 1983 now U.S. Pat. No. 4,492,899 issued Jan. 8, 1985 in the name of the present inventor and assigned to the present assignee.

Like the system of the copending application, the power supply of the present invention is intended to replace the relatively heavy, costly and inefficient transformer power supplies used in the prior art to energize cold cathode luminescent tubes. The system of the invention exhibits an improved power factor as compared with the prior art transformer power supply, in that its power factor is nearly unity or slightly leading, whereas the power factor of the transformer power supply is lagging.

It is, accordingly, a general objective of the present invention to provide a simple and inexpensive solid state regulated power supply for a cold cathode luminescent tube which enables the tube to generate a constant light emission independent of variations in line voltage, independent of variations in internal impedance of the tube, and independent of environmental temperature.

DETAILED DESCRIPTION OF THE ILLUSTRATED EMBODIMENT

Figure 1:
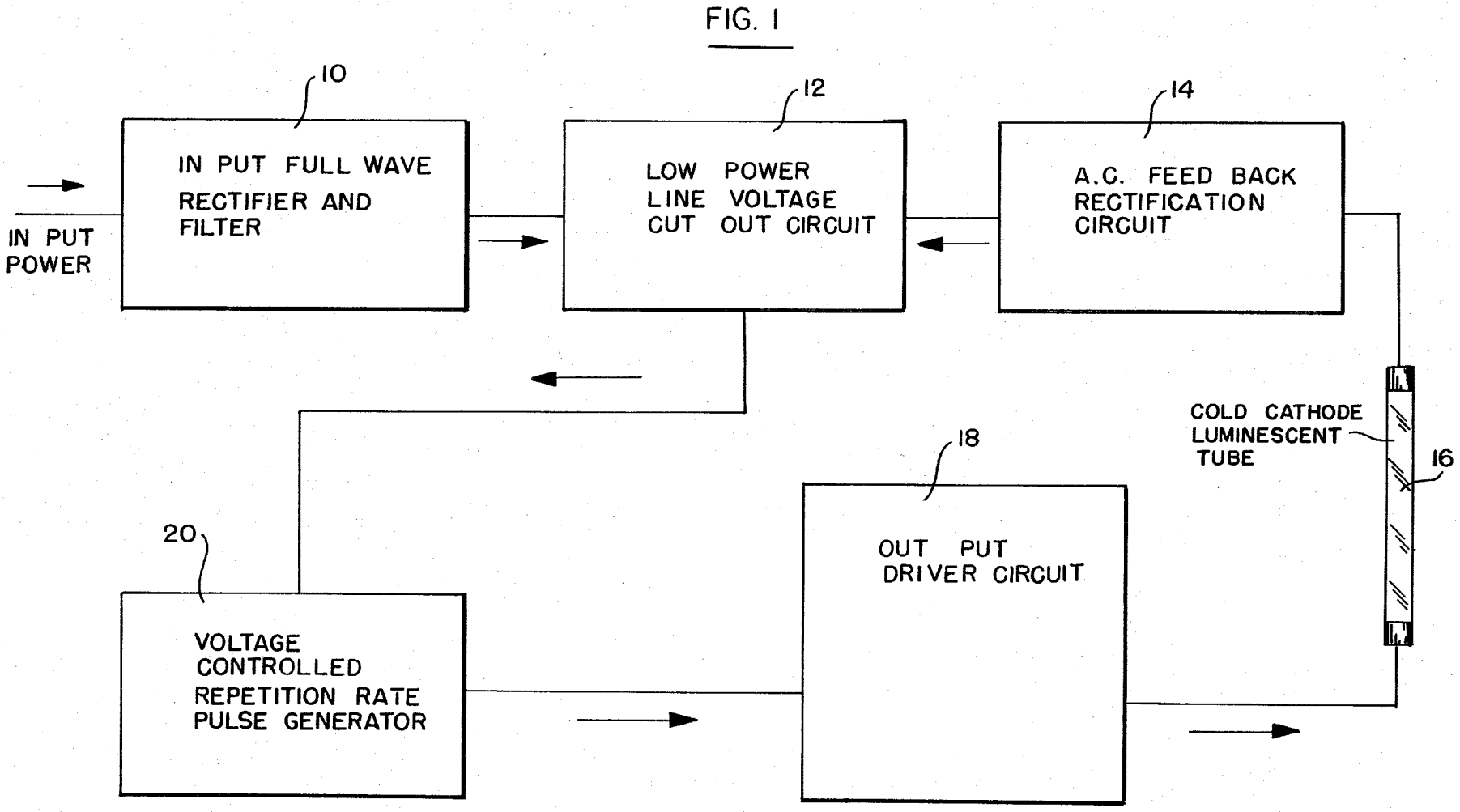
FIG. 1 comprises a block diagram of a solid state power supply representing one embodiment of the invention.

The solid state power supply of the invention, as shown in the block diagram of FIG. 1, includes an input full-wave rectifier and filter 10 which is connected to the line, and whose output is applied to a low power line voltage cut-out circuit 12. The cut-out circuit 12 serves to deenergize the system when the line voltage drops below a certain level so as to prevent certain luminescent tubes, such as Portland orange neon tubes from changing color under such conditions, which would create a hazard when the tubes are used in traffic signals.

The low voltage cut-out circuit 12 is connected to a voltage controlled repetition rate pulse generator 20 whose output is applied to an output driver circuit 18. The cold cathode luminescent tube 16 is connected in series between the output of driver circuit 18 and an alternating current feedback rectification circuit 14. The latter circuit is connected back to the line voltage cut-out circuit 12.

The input full-wave rectifier and filter circuit 10 serves to rectify alternating current power of 200 watts maximum. The power factor of the rectifier and filter 10 is greater than 90°. The circuit is connected across the alternating current line or a direct current power source. The line voltage may vary, for example, from 85 volts to 135 volts, and its frequency may extend from 40 Hz to 1000 Hz, or it may be direct current.

Figure 2:
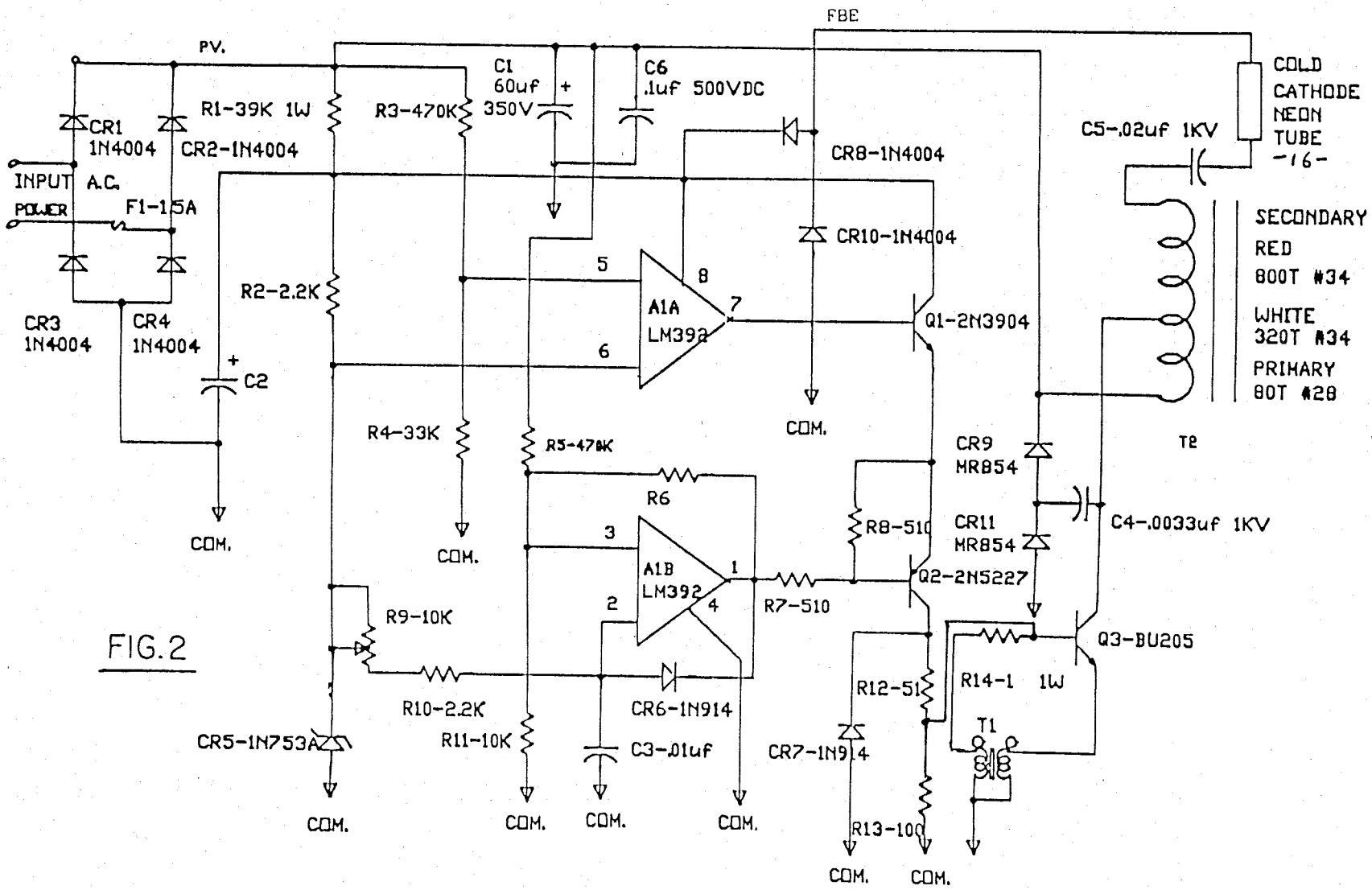
FIG. 2 is a circuit diagram of the system of FIG. 1.

The full-wave rectifier and filter circuit 10, as shown in FIG. 2, comprises diodes CR1, CR2, CR3 and CR4 which form a full-wave rectifier. These diodes, as indicated, may be of the type designated 1N4004. A 1.5 amp fuse F1 may be included in the circuit, as shown.

The filter circuit includes a 60 microfarad capacitor C1 and a 0.1 microfarad capacitor C6. The direct current output voltage from the full-wave rectifier and filter appears on the lead designated PV.

The low power line voltage cut-out circuit 12 is formed by operational amplifier A1A, a 39 kilo-ohm resistor R1, a 2.2 kilo-ohm resistor R2, a diode CR5, a 470 kilo-ohm resistor R3, a 33 kilo-ohm resistor R4, and an NPN transistor Q1. Amplifier A1A may be of the type designated LM392, and transistor Q1 may be of the type designated 2N3904. Diode CR5 may be of the type designated 1N753A.

The power for the low power cut-out circuit is supplied through resistor R1 from the rectifier and filter circuit. The reference voltage for the cut-out circuit is taken from diode CR5. The power voltage on lead PV is divided down through resistors R3 and R4 and monitored at pin 5 of operational amplifier A1A. The voltage at pin 5 of operational amplifier A1A is compared with the reference voltage at pin 6. Whenever the voltage at pin 5 is below the voltage at pin 6, the output of operational amplifier A1A (pin 7) becomes low (logic 0), and when that occurs, the entire system is de-activated.

As mentioned above, the purpose of the low line cutout circuit 12 is to inhibit cold cathode luminescent tubes, such as, for example, Portland orange neon tubes, from turning green during low line voltage conditions, due to the increased operational frequency of the voltage controlled repetition rate pulse generator 20 during such conditions.

The voltage controlled repetition rate pulse generator 20 generates constant duration variable repetition rate pulses. The generator includes an operational amplifier A1B, together with a 10 kilo-ohm potentiometer R9, a 2.2 kilo-ohm resistor R10, a 470 kilo-ohm resistor R5, a 10 kilo-ohm resistor R11, a 100 kilo-ohm resistor R6, a diode CR6, a 510 ohm resistor R7, a 510 ohm resistor R8, a PNP transistor Q2, a 0.01 microfarad capacitor C3, a 100 ohm resistor R13, and a 51 ohm resistor R12.

Operational amplifier A1B may be of the type designated LM392, diode CR6 may be of the type designated 1N914 and transistor Q2 may be of the type designated 2N5227.

The repetition frequency of the output of pulse generator 20 varies inversely as the summation of the voltage on lead PV and a feedback power and supply voltage appearing on lead FBE. This summation voltage is applied to pin 3 of amplifier A1B. The voltage on lead PV is transferred and summed at pin 3 of amplifier A1B through a 470 kilo-ohm resistor R5. The feedback voltage on lead FBE is half-wave rectified by diodes CR8 and CR10. Whenever the Q1 transistor switch is conductive due to a proper line voltage on lead PV, the rectified feedback voltage summed through Q1, and resistors R8 and R6 to pin 3 of amplifier A1B.

The reference for the repetition rate pulse generator 20 is the voltage existing across diode CR5. Potentiometer R9 is used to adjust the operational frequency of the generator at any given summation of the voltages on leads PV and FBE. The output of operational amplifier A1B (pin 1) supplies proper operational voltage pulses to drive transistor Q2 into saturation. Transistor Q2 is connected as a buffer amplifier for operational amplifier A1B. Resistor R12 serves as an output current limiter for the repetition rate pulse generator.

The output driver circuit 18 is formed of an NPN transistor Q3 which may be of the type designated BU205. The circuit also includes a 100 ohm resistor R13, a 1 ohm resistor R14, an autotransformer T1, diodes CR9 and CR11 which may be of the type designated MR854, a transformer T2, a 0.0033 microfarad capacitor C4 and a 0.02 microfarad capacitor C5. The collector of transistor Q3 is connected to a tap on the winding of autotransformer T2. The neon tube 16 is coupled to one side of the winding through capacitor C5. The power voltage lead PV is connected to the other side of the winding.

A low-level signal is supplied to the base of transistor Q3 from the repetition rate pulse generator. The transistor Q3 has a current gain of two and amplifies the signal from its own base to the regenerative drive transformer T1. Transformer T1 supplies the base of transistor Q3 in a regenerative form, driving the transistor into hard saturation. After about ten microseconds the regenerative drive transformer saturates and the regenerative drive to the base of transistor Q3 diminishes to zero. The collapsing magnetic field of transformer T2 causes a large negative current to flow through transistor Q3 and transformer T1, thus resetting the regenerative drive transformer so that a sequential drive pulse will once again operate the regenerative circuit logic.

The output driver circuit is connected to one side of the cold cathode luminescent tube 16 which may, for example, be a neon tube, and it supplies controlled high voltage alternating current pulses to the neon tube. Transformer T1 is a regenerative feedback saturable drive transformer, and it supplies drive regenerative power to transistor Q3 whenever a signal pulse is received from the repetition rate generator. The transistor Q3 and transformer T1 generate power pulses for autotransformer T2, which serves as the output flyback transformer.

Capacitor C4, and diodes CR9 and CR11 limit the maximum voltage of the autotransformer T2, and dissipate only the power caused by the voltage drop of the diodes CR9 and CR11. Capacitor C5 blocks DC voltage from the neon tube load.

The alternating current feedback rectification circuit 14 of FIG. 1 is formed by diodes CR8 and CR10, which may be of the type designated 1N4004, and by a 0.1 microfarad capacitor C2. The current in neon tube 16 is half-wave rectified in the feedback rectification circuit and filtered, and is utilized as a summation voltage component for the voltage controlled repetition rate pulse generator, as described above.

In the system of the invention, the repetition rate pulse generator is controlled by the summation of the line voltage and a voltage corresponding to the feedback current, as described above, so that the light emission of the cold cathode luminescent tube may be independent of line voltage variations, changes in ambient temperature, and changes in the internal impedance of the tube.

The inclusion of the low power line voltage cut-out circuit prevents, for example, a Portland orange neon tube from turning green due to low line regulated high frequency pulses from the pulse generator 20, which would create hazards when the tube is used in a traffic signal.

The system also includes regenerative drive transformer T1 which supplies regenerative power to the switching transistor Q3 whenever a signal pulse is received from the pulse generator 20, causing the driver output circuit to generate a power pulse for the autotransformer T2.

The invention provides, therefore, a simplified regulated solid state power supply for a cold cathode luminescent tube, such as a neon tube, which is light and efficient, and is simple and inexpensive to construct. The system of the invention is capable of maintaining essentially constant light output from the neon tube through a wide range of line voltages, ambient temperature variations, and variations in the internal impedance of the tube.

It will be appreciated that while a particular embodiment of the invention has been shown and described, modifications may be made. It is intended in the claims to cover all modifications which come within the spirit and scope of the invention.

What is claimed is:

1. A regulated solid state power supply system for a cold cathode luminescent neon tube, and the like comprising: an auto transformer having a winding; a power input circuit adapted to be connected to an energy source for providing a power voltage for the system and having its output connected to one side of the auto transformer winding; a voltage controlled repetition rate pulse generator connected to the output of said power input circuit for producing constant duration output pulses at a variable repetition rate; an output driver circuit connected to the output of said pulse generator and to a tap on the auto transformer winding for generating a power pulse for the auto transformer in response to each output pulse from the pulse generator; a feedback circuit having an output connected to the input of the pulse generator for producing a summation voltage for the pulse generator to control the repetition rate of the output pulses therefrom in conjunction with the power voltage from the power input circuit; and a cold cathode luminescent tube coupled in series with the other side of the auto transformer winding and the feedback circuit for providing feedback current to the feedback circuit.

2. The regulated solid state power supply system defined in claim 1, in which said power input circuit includes a full-wave rectifier and filter network.

3. The regulated solid state power supply system defined in claim 1, in which said output drive circuit includes a switching transistor connected to said tap on said auto transformer, and a regenerative feedback saturable drive transformer connected to said transistor to supply drive regenerative power to said transistor whenever an output pulse is received from said pulse generator.

4. The regulated solid state power supply system defined in claim 1, in which said feedback circuit includes an alternating current feedback rectifier network.

5. The regulated solid state power supply system defined in claim 1, and which includes a low power voltage cut-out circuit connected to said power input circuit for de-activating the system when the power voltage from said power input circuit drops below a predetermined level.

6. The regulated solid state power supply system defined in claim 5, in which said power cut-out is also connected to said feedback circuit to be further responsive to the level of the summation voltage therefrom.

* * * * *